US012326086B2

(12) United States Patent
Ruotsalainen

(10) Patent No.: US 12,326,086 B2
(45) Date of Patent: Jun. 10, 2025

(54) APPARATUS FOR RESIN INJECTION, MINING MACHINE AND METHOD

(71) Applicant: SANDVIK MINING AND CONSTRUCTION OY, Tampere (FI)

(72) Inventor: Pasi Ruotsalainen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/033,004

(22) PCT Filed: Dec. 27, 2021

(86) PCT No.: PCT/EP2021/087691

§ 371 (c)(1),
(2) Date: Apr. 20, 2023

(87) PCT Pub. No.: WO2022/090581

PCT Pub. Date: May 5, 2022

(65) Prior Publication Data

US 2023/0399947 A1 Dec. 14, 2023

(30) Foreign Application Priority Data

Oct. 27, 2020 (EP) ..... 20204134

(51) Int. Cl.
*E21D 20/02* (2006.01)
*E21D 20/00* (2006.01)

(52) U.S. Cl.
CPC ..... *E21D 20/025* (2013.01); *E21D 20/00* (2013.01)

(58) Field of Classification Search
CPC ..... E21D 20/025; E21D 20/00; E21D 20/028
See application file for complete search history.

(56) References Cited

U.S. PATENT DOCUMENTS 4,652,175 A * 3/1987 Mauthe ..... E21D 20/028 405/303
2007/0264088 A1* 11/2007 Richter ..... E21D 20/025 405/259.5
2011/0070035 A1* 3/2011 Ricardo ..... E21D 20/028 405/259.5
2011/0168398 A1 7/2011 Gray
2012/0243947 A1* 9/2012 Gotzfried ..... E21D 21/0053 405/259.6
2019/0145257 A1 5/2019 Faulkner et al.
2020/0095862 A1 3/2020 Manttari et al.

FOREIGN PATENT DOCUMENTS

WO 2019083430 A1 5/2019

* cited by examiner

*Primary Examiner* — Benjamin F Fiorello
*Assistant Examiner* — Stacy N Lawson
(74) *Attorney, Agent, or Firm* — Corinne R. Gorski

(57) ABSTRACT

An apparatus for injecting grouting material, mining machine and method of injecting grouting resin into several drilled holes is provided. The apparatus includes an injector head provided with a mixing device, which are both insertable into a drilled hole by a flexible feed hose. The injector head includes a valve assembly mounted inside a distal end portion of the feed hose.

12 Claims, 5 Drawing Sheets

APPARATUS FOR RESIN INJECTION, MINING MACHINE AND METHOD

RELATED APPLICATION DATA

This application is a § 371 National Stage Application of PCT International Application No. PCT/EP2021/087691 filed Dec. 27, 2021 with priority to EP 20204134.9 filed on Oct. 27, 2020.

BACKGROUND OF THE INVENTION

The invention relates to an apparatus for injecting grouting resin into a drilled hole in order to reinforce rock. More specifically the solution relates to feeding of bulk-like fluid resin material.

The invention further relates to a mining machine provided with an apparatus for injecting grouting material and to a method of reinforcing rock surfaces by injecting grouting material into several drilled holes.

In mines, construction sites and at other work areas exists a need to reinforce rock surfaces and to thereby ensure their safety and suitability for the intended purposes. A common method for rock reinforcement is to inject resin material into drilled holes. There are several different systems for inserting the resin material. However, the present injecting means have shown to contain some disadvantages.

BRIEF DESCRIPTION OF THE INVENTION

An object of the invention is to provide a novel and improved apparatus for feeding resin material into drilled holes. The invention further relates to a novel and improved mining machine and to a method of feeding resin material when reinforcing rock surfaces.

An idea of the disclosed solution is that bulk-like resin in fluid form is injected into drilled holes before inserting rock bolts into the drilled holes. The grouting resin is injected by means of an apparatus comprising an injector head insertable inside the drilled hole and comprising a mixing device. The apparatus further comprises a fluid inlet arrangement connected to the injector head for feeding resin base component A and a resin catalyst B to the injector head. The mixing device is configured to mix the fed resin base component A and the catalyst B together. The injector head and the mixing device are fed together inside the drilled hole for the duration of the injection process. The feeding is executed by means of a flexible feed hose which is also configured to provide coverage for feed lines of the fluid inlet system. The injector head comprises a valve assembly for controlling feeding of the grouting material. The valve assembly is located inside the feed hose whereby the feed hose is serving as a tubular cover element also for the valve assembly. In other words, the distal end of the feed hose is provided with the internal valve assembly or unit.

Further, in the disclosed solution the feed hose is fed inside the drill hole for the duration of the resin feed measures and removed from the drill hole when the resin feed is completed. Thus, the feed hose is only temporarily inside the drill hole and is not left therein. The feed hose and the injector head are to be used for several times for several drilled holes. In other words, the injector head provided with the valve module and the mixer device, and the feed hose are not single used devices. Further, they are all separate physical elements in relation to a rock bolt.

An advantage of the disclosed solution is that the internal valve assembly does not increase diameter of the feed system fed inside the drill hole. A further advantage is that the valve assembly is surrounded by the covering feed hose, which facilitates axial movements of the feed system inside the drill hole. The disclosed solution is especially advantageous for conditions where the drill holes tends to collapse and retracting the feed system is difficult.

A further advantage of the disclosed solution is that the structure may be simple, durable and inexpensive too when compared to the known solutions. The disclosed solution may be implemented in different rock drilling rigs and reinforcing machines. The system may also be easily retrofitted to the existing mining devices.

According to an embodiment, the feed hose is flexible so that it bends, and its cross profile deforms temporarily during the axial movement if needed. However, the feed hose is relatively rigid in axial direction so that it can be pushed and pulled axially inside the drilled hole. An outer surface of the feed hose has a low friction coefficient. Also, this feature facilitates feeding of the feed system and allows the feed system to be retracted also from damaged drilled holes.

According to an embodiment, the flexible feed hose is made of low friction polymeric material. Then the feed hose adapts to possible variations in form and dimensions of the drilled hole. The feed hose may be made of polyethylene (PE) or polyethylene medium density (PEM), for example.

According to an embodiment, greatest cross sectional dimension of the apparatus corresponds to outer diameter of the feed hose. In other words, all the other components of the apparatus have minor or equal diameter compared to the feed hose.

According to an embodiment, an inner diameter of the feed hose is 30-50 mm. An outer diameter of the valve assembly or module is dimensioned in accordance with inner diameter of the feed hose.

According to an embodiment, the disclosed valve assembly comprises a body an outer surface of which comprises at least one expandable fastening element configured to be pressed against an inner surface of the feed hose. The mounting is easy and quick to execute. There is no need to make any preparation or handling to the feed hose.

According to an embodiment, the above mentioned expandable fastening element comprises at least one resilient ring-shaped element which is compressed axially so that the element is expanded radially. The mounting is simple and reliable.

According to an embodiment, the expandable fastening element comprises several successive O-rings. Number of the O-rings may be 2-5, for example. The O-rings are inexpensive and durable components.

According to an embodiment, the expandable fastening element comprises at least one locking ring comprising tapering surfaces and configured to move and expand radially when being pushed axially by means of another tapering surface. Alternatively, there may be radially protruding locking toes for clamping to the inner surface of the feed hose.

According to an embodiment, the disclosed valve assembly and the mixing device are separate elements connected axially successively by means of an adapter element mounted between them. In other words, the injector head comprises two functional modules and the connecting adapter element between them facilitating easy removal and change of different types of mixing devices. This way it is possible to change the mixing device easily in response to the used resin material and changes in temperatures and circumstances.

According to an embodiment, the mixing device protrudes axially from the distal end of the feed hose. Then the mixing device is easy to connect and remove, which facilitates replacement of the mixing device or module.

According to an embodiment, the adapter element is located inside the feed hose. Then a joint between the adapter and the mixing device is surrounded and covered by the feed hose.

According to an embodiment, the adapter element is protruding axially from a distal end of the feed hose. In other words, at least part of the adapter is outside the end of the feed hose, whereby connecting surfaces of the adapter are well visible and connectable.

According to an embodiment, the adapter element is a separate component mounted to the valve assembly. There may be screw joint or quick coupling means between the adapter element and the valve module.

According to an embodiment, the adapter element is an integrated non-separable part of the valve module. In other words, the adapter is formed directly to a front end part of the valve module.

According to an embodiment, the adapter element comprises a central axially protruding portion a distal end of which is provided with tapering sealing surfaces and is followed by a connecting thread.

According to an embodiment, an outer surface of the body of the adapter element is sealed against the inner surface of the feed hose. There may be one or more sealing elements arranged on a body of the adapter element. The sealing element may be an O-ring or a lip seal, for example.

According to an embodiment, the mixing device may be provided with an outer sleeve an outer diameter of which corresponds to the outer diameter of the feed hose. The mentioned outer sleeve or sheath may be made of same material as the feed hose. The outer sleeve may be made of polymeric material. Further, the outer sleeve may be a separate tubular component pushed on the mixing device, or alternatively, the outer sleeve or covering may be made on the mixing unit by means of covering and casting methods.

According to an embodiment, the disclosed valve assembly comprises several control valves for selectively closing and opening at least a resin base component feed line, a resin catalyst feed line and at least one solvent medium feed line for flushing the for flushing the injector head.

According to an embodiment, the mentioned control valves are spring loaded non-return valves. These valves are small in size, simple, reliable and inexpensive.

According to an embodiment, the mentioned control valves are hydraulically controlled valves, for example pilot valves. These valves make a more versatile fluid feed control possible.

According to an embodiment, the injector head is a grouting resin feeding tool, whereby the tool is removed from the drilled hole when the resin feeding is completed and before a separate rock bolt is fed into the drilled hole filled with the grouting resin.

According to an embodiment, the mixing device comprises screw surfaces, spirals, amaze or corresponding form surfaces for causing the fed two separate resin component fluid flows to be mixed and to form one homogenous resin mass. The mixing device or element in connection with the injector head is a static mixer with several non-movable mixing elements or surfaces for mixing the fed components together prior being ejected from the injector head. Mounting of the mixing device is designed so that is easy and quick to substitute and clean when needed.

According to an embodiment, the injector head is connected to three feed lines.

According to an embodiment, the injector head is connected to more than three feed lines. There may be two different feed lines for different resin base components A1 and A2, one feed line for the resin catalyst B and one feed line for the solvent or flushing agent. In case the valve module is provided with pressure controlled pilot valves, an additional control line is needed for providing the valve module with control pressure. The mentioned basic resin components A1 and A2 may have different setting times when they are mixed with the catalyst B. The catalyst B is a hardener for a chemical reaction to start turning the resin from a liquid to a solid.

According to an embodiment, the apparatus comprises a solvent feeding system configured to feed solvent medium for flushing the injector head and the mixing device. The aim of the system is to prevent clogging in situations when there are breaks between the injections of the drilled holes.

According to an embodiment, the resin material mixed in the mixing device is flushed by means of the solvent medium out of the injector head. The system may be cleaned by pushing the mixed material outside of the mixing head, outside the drilled hole or to a top of the drilled hole just after the actual grouting resin material is being fed. This way the system is cleaned and can wait between treating several holes.

According to an embodiment, the solution relates to a mobile mining machine comprising a movable carrier, at least one boom connected movably on the carrier and an apparatus for injecting grouting resin into drilled holes. Further, there is at least one bolting unit at a distal end of the boom for feeding rock bolts into the drilled holes after being injected with the grouting resin. The boom is provided with a feed device for moving an injection head of the injecting apparatus inside the drilled hole. The apparatus for injecting the grouting resin is in accordance with the features and embodiments disclosed in this document.

According to an embodiment, the drilled holes may be equipped with rock bolts, rock anchors, cables or corresponding elongated metallic reinforcing elements after the grouting material has been injected. Thus, there are several alternative rock reinforcements that can be mounted inside the drill holes.

According to an embodiment, the solution relates to a method of injecting grouting resin into several drilled holes. The method comprises inserting an injector head inside the drilled hole. The grouting resin is mixed by means of a mixing device of the injector head. A resin base component A and a resin catalyst B are fed to the injector head by means of a fluid inlet arrangement comprising several feed lines. The fed resin base component and the resin catalyst are mixed inside the drilled hole to a resin mixture by means of the mixing device. After the injection is completed the injection head is removed from the drilled hole. Only thereafter a metallic rock reinforcement is mounted inside the drilled hole. The method further comprises feeding the injector head into the drilled hole by means of a flexible feed hose which surrounds the feed lines of the fluid inlet arrangement. The feeding of the resin material to the mixing device is controlled by means of a valve assembly mounted inside a distal end part of the feed hose. Thus, the feed hose provides coverage at least for the feed lines and the valve assembly and thereby facilitates their axial movements inside the drill hole.

The above disclosed embodiments and features may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
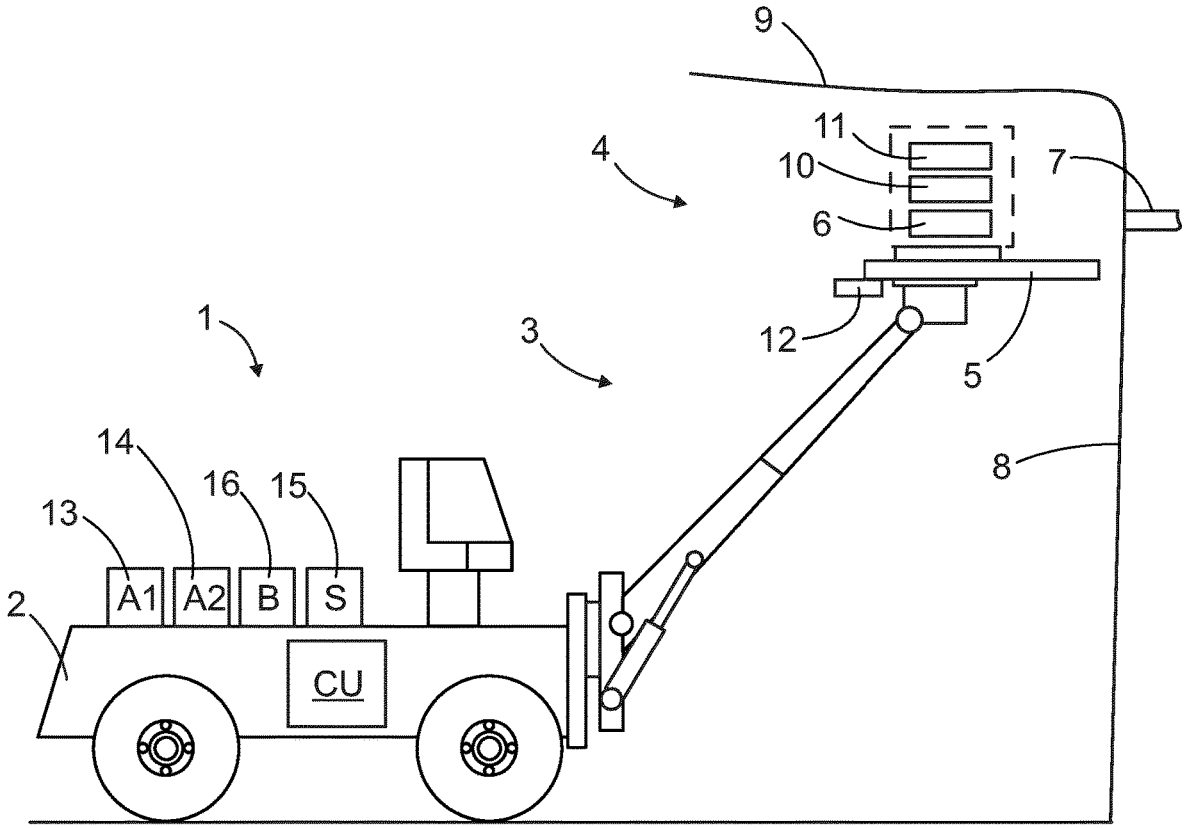
FIG. 1 is a schematic side view of a rock drilling rig intended for underground drilling and rock reinforcing.

FIG. 1 shows a rock drilling rig, which is an example of a mining machine 1. The rock drilling rig comprises a movable carrier 2 and at least one boom 3 connected to the carrier 2. At a distal end portion of the boom 3 is a drilling unit or bolt insertion unit 4. The unit 4 may comprise a feed beam 5 and a rock drilling machine 6 supported on it. A drilling tool is connectable to the rock drilling machine 6. The rock drilling machine 6 comprises at least a rotating device for rotating the drilling tool around its longitudinal axis. The rock drilling machine 6 and the boom 3 may be turned so that drill holes 7 can be drilled to walls 8 and ceilings 9 of tunnels and other underground spaces in order to mount reinforcing rock bolts. The unit 4 may also be provided with a bolting unit 10 and an apparatus 11 for feeding grouting resin mixtures. The drilling machine 6, the bolting unit 10 and the resin feeding apparatus 11 may be connected to the drilling unit 4 so that they can be indexed on central axis of the drilled hole 7, or alternatively they all or some of them can be mounted to dedicated booms or other support structures. At the distal end of the boom 3 is at least one feed device 12 for moving the devices 6, 10, 11 relative to the distal end of the boom 3. Further, on the carrier 2 there may be a first container 13 provided for a first resin base component A1, a second container 14 provided for a second resin base component A2, a third container 15 for a solvent medium S and a fourth container 16 for a resin catalyst B.

Figure 2:
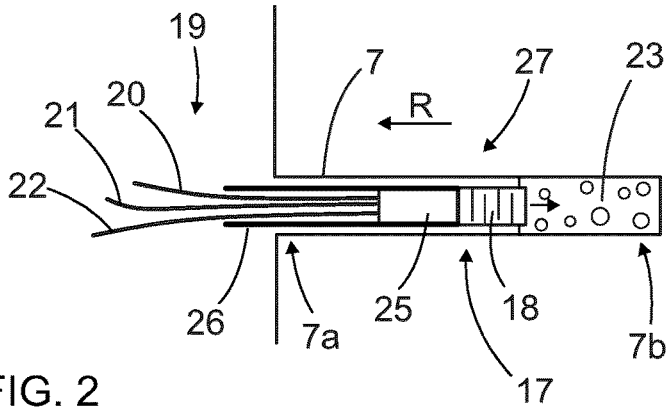
FIG. 2 is a schematic side view of an arrangement for feeding grouting material into a drilled hole.

FIG. 2 discloses an apparatus 27 for inserting resin material to a drilled hole 7 provided with an opening 7*a* and a bottom 7*b*. Inside the drilled hole 7 is inserted an injector head 17 provided with a mixing device 18. The injector head 17 is connected to a fluid inlet arrangement 19 comprising a first feed line 20, a second feed line 21 and an optional third feed line 22. The first feed line 20 is a feed line for component A, whereas the second feed line is dedicated for the component B. The third feed line 22 is for feeding the solvent agent S, but the system may be without any third line 22 if line 20 or 21 is used for solvent feeding. The feed lines 20-22 may be hoses or tubes. In FIG. 2 resin mixture 23 is fed through the injector head 17 and the mixing device 18 to the bottom 7*b* of the drilled hole 7. The system or apparatus 27 is retracted R simultaneously during the injection.

FIG. 2 further discloses that the injector head 17 of the apparatus 27 comprises a valve assembly 25 which is mounted inside a feed hose 26. The feed hose 26 surrounds also the feed lines 20-22. The injector head 17 movable by means of the feed hose 26.

Figure 3:
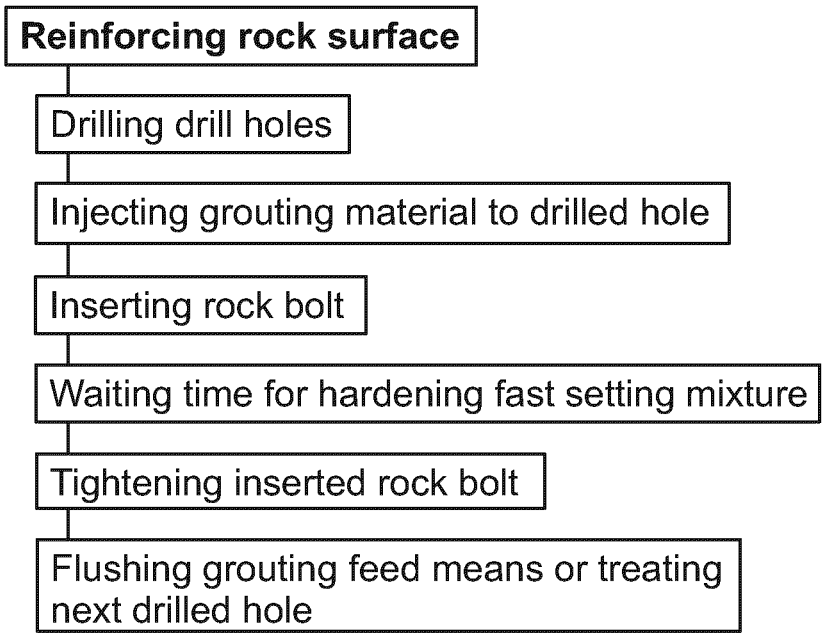
FIG. 3 is a schematic diagram showing some features relating to reinforcing measures of a rock surface.

FIG. 3 discloses steps relating to reinforcing rock surfaces. These issues have already been discussed above in this document.

Figure 4:
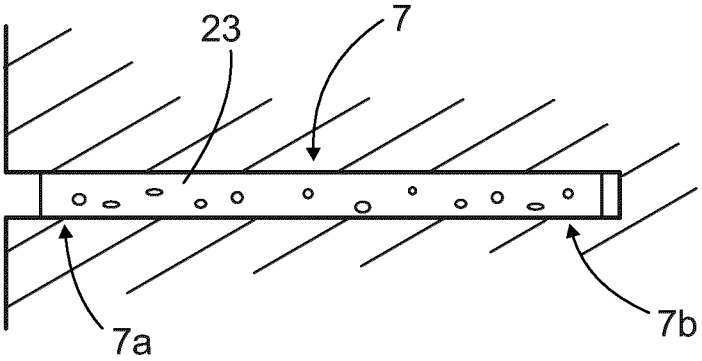
FIG. 4 is a schematic side view of a drilled hole after being filled with resin material.

FIG. 4 discloses that a drilled hole 7 is filled with a resin mixture 23.

Figure 5:
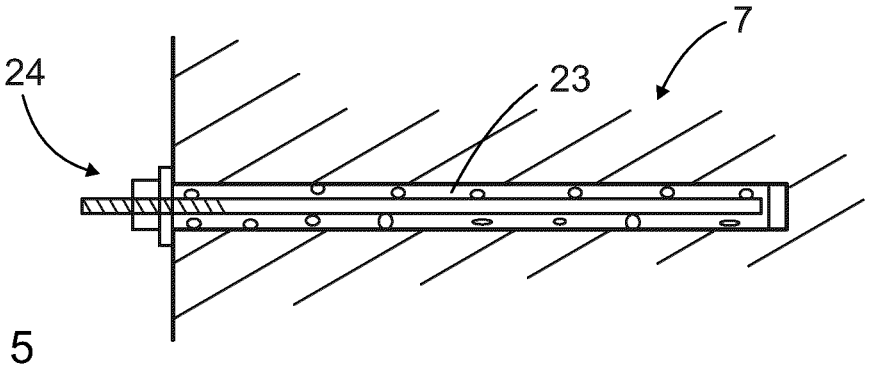
FIG. 5 is a schematic side view of the drilled hole of FIG. 4 after being equipped with a rock bolt.

In FIG. 5 a rock bolt 24 is pushed into the drilled hole 7 so that it is inside the resin mixture 23 which hardens and locks the rock bolt 24. The rock bolt 24 can be tightened by means of screw means so that a desired pretension can be achieved.

Figure 6:
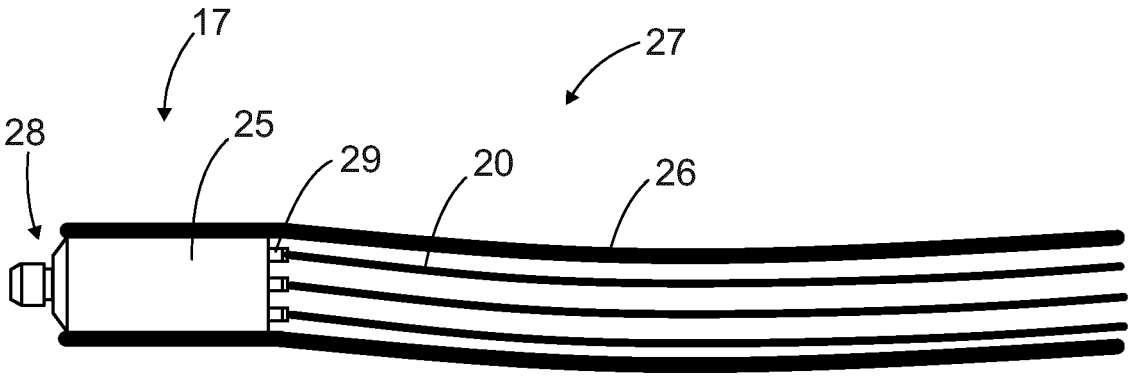
FIG. 6 is schematic side view of an apparatus for injecting grouting material to a drilled hole, FIG. 7 a schematic side view of a feed hose intended for receiving a valve assembly and fluid feed hoses.

FIG. 6 discloses an apparatus 27 provided with a bendable feed hose 26 a distal end of which comprises a valve assembly 25. A front end of the valve assembly 25 is provided with an adapter element 28 for connecting a mixing device. The adaptor element may protrude axially from the feed hose 26 and may comprise quick coupling means. FIG. 6 further discloses feed ports 29 or connectors for connecting the feed lines 20 to the valve assembly 25.

Figure 7:
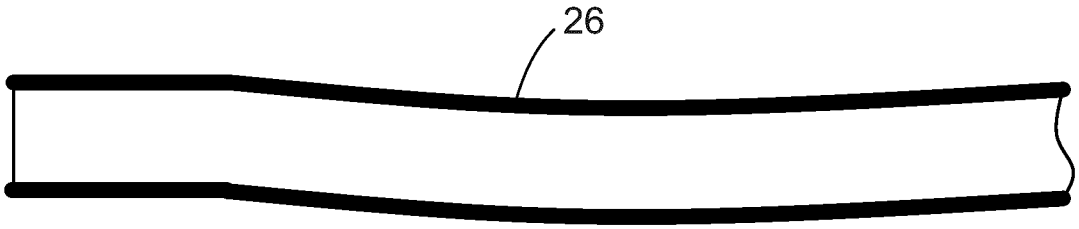

FIG. 7 discloses a feed hose 26 which may be a flexible tubular element made of polymer material, such as plastic material having an outer surface with good frictional properties.

Figure 8:
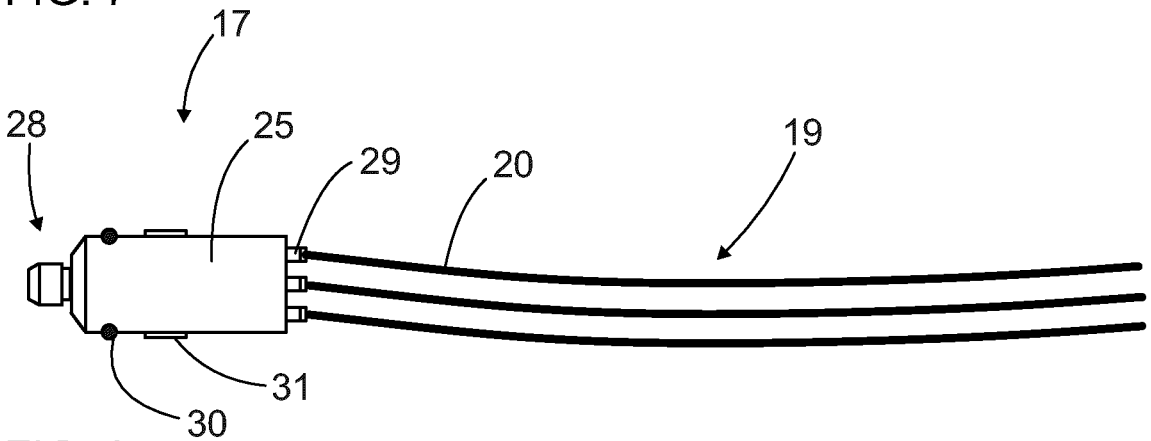
FIG. 8 is a schematic side view of a valve assembly provided with an integrated adaptor head and connected to a fluid feed lines.

FIG. 8 discloses an injector head 17 prior being mounted inside a feed hose. An outer surface of a body of the injector head 17 is provided with sealing elements 30 and fastening elements 31.

In FIGS. 6 and 8 the adapter element 28 is an inseparable part of the valve assembly 25, whereas in FIGS. 9-13 the adapter element 28 is shown to be a separate module mounted to a front end of the valve assembly 25.

Figure 9:
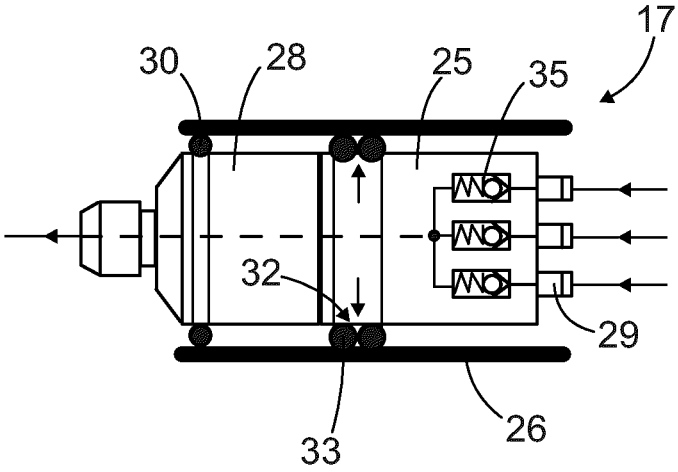
FIG. 9 is schematic side view of a module comprising a valve assembly and a separate adapter component.

FIG. 9 discloses that an injector head 17, and more specifically, a valve assembly 25 may comprise a body an outer surface of which comprises an expandable fastening element 32 configured to be pressed against an inner surface of a feed hose 26. The fastening system may comprise one or more O-rings 33 which are arranged to expand radially when being pressed axially by means of the fastening system.

Figure 10:
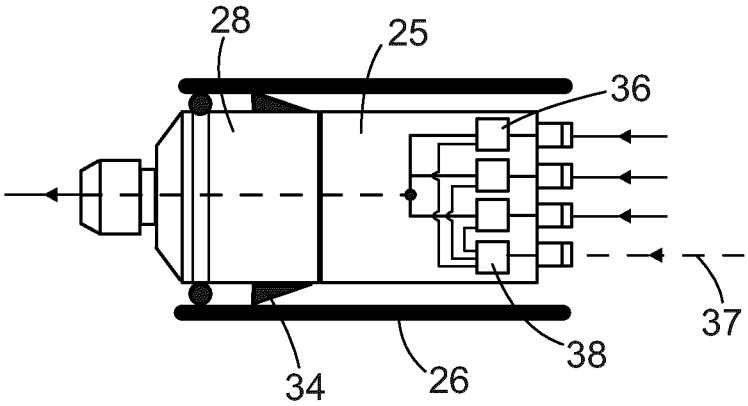
FIG. 10 is a schematic side view of another module with differing control valves and mounting means.

In FIG. 10 there are wedge elements 34 or corresponding transversally or radially protruding elements for providing required fastening forces. The elements may be spring loaded or may be activated by means of screw elements, for example. The fastening system may be on a body of an adapter element 28.

In FIG. 9 the valve assembly comprises spring loaded non-return valves 35, whereas in FIG. 10 there are pressure controlled pilot valves 36. In the latter case there is a pilot control line 37 for transmitting control pressure to control apparatus 38 and further to the valves 36 for activating or controlling them.

Figure 11:
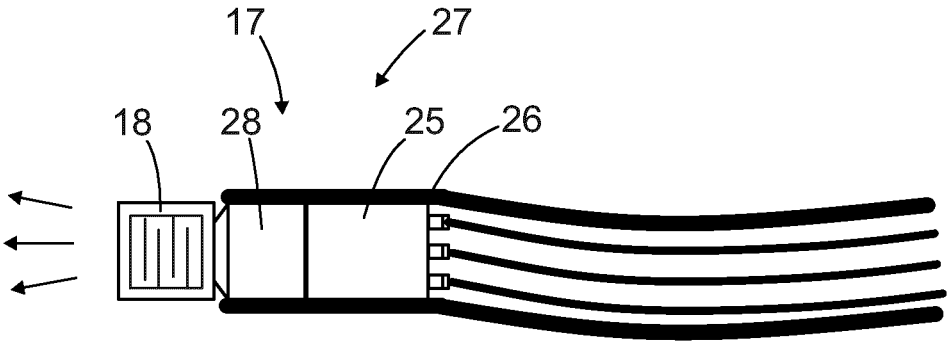
FIG. 11 is a schematic side view of an injector head wherein a mixing unit protrudes from a feed hose.
Figure 12:
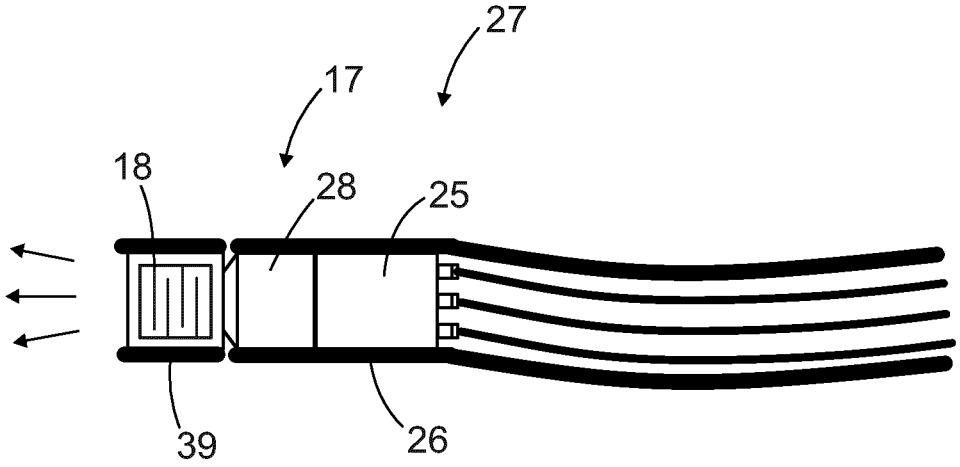
FIG. 12 is a schematic side view of an injector head wherein a mixing unit is surrounded by a covering sleeve element.
Figure 13:
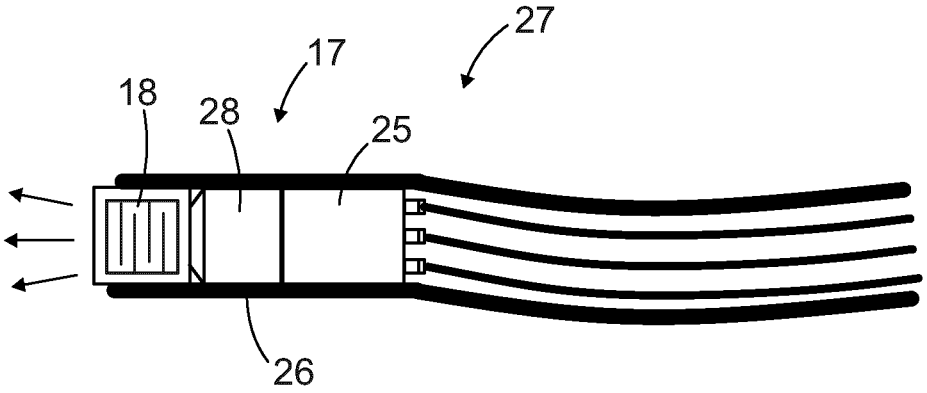
FIG. 13 is a schematic side view of an injector head wherein a mixing unit is partly inside a feed hose.

FIG. 11 discloses a solution wherein a mixing device 18 is outside a feed hose 26. In FIG. 12 there is an outer sleeve 39 arranged to surround a mixing device 18. In FIG. 13 the mixing device 18 is partly inside the feed hose 26. As can be seen, in all cases outer dimensions of the mixing device does not exceed outer dimension of the feed hose 26.

The drawings and the related description are only intended to illustrate the idea of the invention. In its details, the invention may vary within the scope of the claims.

The invention claimed is:

1. An apparatus for injecting grouting resin into a drilled hole for rock reinforcement, wherein the apparatus is arranged for feeding bulk fluid material, the apparatus comprising:

an injector head arranged to be inserted inside the drilled hole;

at least one fluid inlet arrangement connected to the injector head and arranged for feeding a resin base component and a resin catalyst to the injector head; and an elongated tubular cover element surrounding the fluid inlet arrangement, wherein the injector head is provided with a mixing device arranged for mixing the fed resin base component and the catalyst together, whereby the mixing device is configured to be fed together with the injector head and the cover element inside the drilled hole, the injector head including a valve assembly located inside a flexible feed hose serving as the tubular cover element, wherein the injector head is a grouting resin feeding tool, wherein the grouting resin feeding tool is removed from the drilled hole when the resin feeding is completed and before a separate rock bolt is fed into the drilled hole filled with the grouting resin.

2. The apparatus as claimed in claim 1, wherein the valve assembly includes a body having an outer surface, which includes at least one expandable fastening element configured to be pressed against an inner surface of the feed hose.

3. The apparatus as claimed in claim 1, wherein the valve assembly and the mixing device are separate elements connected axially successively by an adapter element mounted therebetween.

4. The apparatus as claimed in claim 1, wherein the valve assembly includes a plurality of control valves for selectively closing and opening at least a resin base component feed line, a resin catalyst feed line and at least one solvent medium feed line for flushing the injector head.

5. The apparatus as claimed in claim 1, wherein the valve assembly includes a plurality of spring-loaded non-return valves.

6. The apparatus as claimed in claim 1, wherein the feed hose is made of polymeric material.

7. The apparatus as claimed in claim 1, wherein the mixing device is provided with an outer sleeve having an outer diameter, which corresponds to an outer diameter of the feed hose and wherein the sleeve is made of polymeric material.

8. The apparatus as claimed in claim 1, wherein the mixing device is configured to protrude axially from a distal end of the feed hose.

9. The apparatus as claimed in claim 1, wherein a greatest cross-sectional dimension of the apparatus corresponds to an outer diameter of the feed hose.

10. A mining machine comprising:

a movable carrier;

at least one boom connected movably on the carrier;

an apparatus according to claim 1, arranged for injecting grouting resin into drilled holes; and at least one bolting unit disposed at a distal end of the at least one boom and arranged for feeding rock bolts into the drilled holes after being injected with the grouting resin, wherein the boom is provided with a feed device arranged for moving the injector head of the apparatus inside the drilled hole.

11. A method of injecting grouting resin into a plurality of drilled holes, the method comprising:

inserting an injector head inside a drilled hole;

providing the injector head with a mixing device;

feeding a resin base component and a resin catalyst to the injector head by a fluid inlet arrangement;

mixing the fed resin base component and the resin catalyst to form a resin mixture inside the drilled hole by the mixing device;

completing the mixing and removing the injector head from the drilled hole prior to inserting a metallic rock reinforcement inside the drilled hole;

feeding the injector head into the drilled hole by a flexible feed hose which surrounds feed lines of the fluid inlet arrangement; and controlling feeding of the resin base component and the resin catalyst to the mixing device by a valve assembly mounted inside a distal end part of the feed hose.

12. The method as claimed in claim 11, further comprising selecting the mixing device and mounting it in a removable manner to the valve assembly by an adapter element.

* * * * *